US005793290A

United States Patent [19]

Eagleson et al.

[11] Patent Number: 5,793,290

[45] Date of Patent: Aug. 11, 1998

[54] AREA SECURITY SYSTEM

[75] Inventors: James G. Eagleson, Waukesha; Peter G. Scharpf, Hartford; Hua Zong, Milwaukee; Paul R. Ahlf, Oak Creek; Kurt P. Schoeckert, Hartford, all of Wis.

[73] Assignee: RF Technologies, Inc., Brookfield, Wis.

[21] Appl. No.: 608,678

[22] Filed: Feb. 29, 1996

[51] Int. Cl.[6] ..... G08B 23/00

[52] U.S. Cl. ..... 340/573; 340/539; 340/693

[58] Field of Search ..... 340/573, 572, 340/528, 539, 693; 455/100

[56] References Cited

U.S. PATENT DOCUMENTS

| | | | |
|---|---|---|---|
| 3,478,344 | 11/1969 | Schwitzgebel et al. | 340/539 X |
| 4,095,214 | 6/1978 | Minasy | 340/572 X |
| 4,682,155 | 7/1987 | Shirley | 340/573 |
| 4,853,692 | 8/1989 | Wolk et al. | 340/573 |
| 4,899,134 | 2/1990 | Wheeless, Jr. | 340/573 |
| 4,980,671 | 12/1990 | McCurdy | 340/573 X |
| 5,014,040 | 5/1991 | Weaver et al. | 340/572 |
| 5,457,440 | 10/1995 | Daddono | 340/573 |
| 5,512,879 | 4/1996 | Stokes | 340/573 |
| 5,608,382 | 3/1997 | Webb et al. | 340/573 |

OTHER PUBLICATIONS

Brochure on "Keep Your Patients' Bundle of Joy Safely Bundled!" by Accutech, date unknown.

Brochure on "Infant Abductions Alarm Systems" by CSI, date unknown.

Brochure on "Benefits Of Infant Protection System" by Sensormatic, date unknown.

*Primary Examiner*—Thomas J. Mullen, Jr.

*Attorney, Agent, or Firm*—Andrus, Sceales, Starke & Sawall

[57] ABSTRACT

A security system for monitoring movement of persons in a secured area including set openings which includes area and opening monitors, tag units and an alarm system. The tag unit has special end clamp members which securely clamp an attachment strap to a housing for attaching the unit to a person. Tampering with the connection creates an alarm state. The tag unit includes a dual transmitter continuously transmitting very low frequency (VLF) signal and transmitting a very high frequency (VHF or UHF) signal only if the tag unit is tampered with. The opening monitor includes VLF receivers responsive to a VLF signal and transmitting an alarm signal to an opening alarm system to prevent unauthorized exit. Authorized personnel have a deactivation unit for timed receiver disabling for moving the person through the opening. The UHF transmitter is activated upon unauthorized tampering with the attached tag. A bank response alarm includes a plurality of distributed VHF or UHF receivers which responds to the VHF or UHF signal of any tag unit. A deactivation control is provided to authorized personnel to permit attachment and removal of the tag unit. Other interlocks may be provided including visual and/or audible alarms, tag identification and, data recording.

14 Claims, 8 Drawing Sheets

AREA SECURITY SYSTEM

BACKGROUND OF THE INVENTION

The present invention relates to a mobile locating system for monitoring transport or movement within a restricted area, such as a personnel monitoring system, to detect movement of a person or object from a restricted area by passage through monitored passageways, such as a doorway, gate, elevator and other areas of ingress and egress, and particularly for monitoring movement of an infant or child from within a secure environment.

The possible abduction of an infant or child from medical facilities, such as hospitals, other medical structures, temporary housing and other restricted areas, has created a significant demand for monitoring systems which signal any unwarranted movement of the infant or child from the assigned environment or area. The standard method used heretofore, such as visitor passes, monitoring cameras, and standard door monitors have not provided the necessary protection against such unwarranted movement of personnel, and particularly an infant or child, from an assigned or restricted area. Hospitals and like facility are thus continuously looking for improved systems which will particularly prevent unwarranted movement and abduction of an infant or child and maintain a very safe and secure environment for the infants and other such personnel. The present invention has been particularly developed for securing an infant or child movement and is therefore described with reference thereto. The system may, of course, be applied to other persons or objects and even other applications.

Recent systems have been proposed in which an alarming band unit is connected to the monitored child. The restricted area includes strategically located receivers throughout the restricted area. The receivers are responsive to the output of the alarming band unit and coupled to one or more controllers. The alarming band unit includes a transmitter unit for establishing a control signal when the band unit is moved adjacent to an alarm receiver and is constructed such that any tampering or removal of the alarming band unit also generates a wider area alarm signal. The local area receivers are small units, which are suitably mounted adjacent to the strategic location, such as a door, hall, elevator, or the like, and are generally interconnected to an alarm control unit. With present day technology, the receivers are generally mounted to wall, ceiling, or other similar locations and are hard wired to a controller unit. The latter, in turn, is generally mounted in the restricted area and coupled to alarm or alert units mounted for signalling the staff, such as the nursing staff and security personnel as well as providing certain interlocks to restrict movement of the monitored child. Generally, if the alarming band unit is compromised in any way, the transmitter sends the signal to additional, wide area receivers and/or detects the loss of the signal and will immediately generate an appropriate response, which may be an alarm transmission to other remote locations, and the like.

Various systems have been suggested. For example, U.S. Pat. No. 5,014,040, issued May 7, 1991, discloses a personal locator adapted to be mounted to the wrist or leg of the infant or any other monitored person. The locator consists of a small transmitter having an attachment band integrally secured to the transmitter housing, which preferably has the appearance of a wristwatch or the like. The integrally connected band is adapted to be wrapped about the arm and then secured within a special opening within the opposite side of the transmitter housing. The band itself has embedded therein conductors which are interconnected to the transmitter at the integral connection and also through a releasable connector at the opposite strap connector which receives the free end of the attachment strap. The transmitter generates a unique identification code information or the like, which is transmitted with sufficient power to cover the restricted area in which receivers are mounted directly or as a result of selected movement within an area. Other prior art patents noted in the above patent are in the same general areas of classification within the United States Patent Office.

The prior art systems generally use alternate systems of monitoring. Some systems use a transponder system wherein a non-transmitting individual personalized unit is secured to the person. The unit transmits a coded signal upon being interrogated by a remote detector or a remote monitoring unit. Alternatively, a portable self contained transmitting and receiving device is worn by the personnel, and when it enters into a selected area, it activates a control unit to effect an alarm condition. Under an alarm condition, an audible or visual signal may be generated at one or more locations. In addition, various securing action may be taken, such as locking of a door, deactivating of an elevator system, providing notifications at local and remote stations, as well as any other option, which may be desired to be incorporated into a system to secure the locations as well as protect the personnel.

Authorized personnel will normally have deactivation systems which permit them to undertake normal personnel servicing and the like. In addition, it is highly desirable to prevent tampering with the system, and particularly the child attached unit and the receiver units. Thus, any unauthorized attempt to remove the unit from the person being monitored, or tampering therewith in such a manner as to defeat the security system, must automatically create an alarm or an alert condition for appropriate monitoring and action.

Although various systems presently exist in personal monitoring systems, many of which are particularly directed to the monitoring of movement of infants and children in hospitals and other like areas or facilities, there is a continuing need for security systems which are highly cost effective and are at least as secure as those presently available and preferably have or permit greater levels of security. Both the monitor unit attached to the person as well as the monitoring sensors must be secure and totally effective under all positioning and movements of the monitored person.

SUMMARY OF THE PRESENT INVENTION

The present invention is particularly directed to a system having a dual transmitting monitor or tag unit coupled to the monitored child and having distinct dual signal modes in combination with strategically located receiving units and controllers to separately respond to the dual signals. Thus, generally in accordance with the present invention, a small tag unit includes a dual signal transmitting system establishing two distinctly different signals, the tag unit includes an attachment band or strap for interconnection to the child, other personnel or object to be monitored with the dual tag unit. The strap is specially coupled to the transmitting unit such that any removal of or separation within the strap results in the transmission of a unique wide area alarm signal. The alarming strap signal is transmitted over a wide area to simultaneously monitor a plurality of different tag units, each having a proper connection of the strap to a child. The transmitting unit also transmits a much more restricted area signal which only activates receivers at selected locations and thereby the movement of the banded child at certain locations in the restricted area, and particularly into an entry/exit location. Thus, if the alarming strap is cut, the system wiring tampered with, or just removed without deactivation of the system, an alarm signal is automatically and promptly created. If the child, however, properly wearing the dual tag unit moves into a restricted area, the strategically located receiver unit will instantly respond, subject to any desired delay or override features built into the system, and then creates an alarm or alert condition.

More particularly, in accordance with the teaching of one embodiment of the present invention, the alarming tag unit includes a battery operated RF transmitter. In a preferred construction, the tag unit includes a lightweight, waterproof transmitting housing connected by a hypoallergenic band or strap for attachment to the child. The strap is interconnected at the opposite ends to the sides of the housing with at least one releasable connector, and preferably opposite strap connectors, to secure the band to the housing and thereby attach the tag unit in a comfortable manner to the child with any excess band trimmed and removed. The transmitter is sealed within the housing, with the circuit connection completed through wiring within the strap. Any opening of the connection to either side or otherwise interfering with the strap, such as cutting of the strap, will trigger an alarm condition. This ensures continuous operation of the transmitter units and response by the system monitors. The receiver units are secured to the entrance/exit locations such as a doorway, hallway, elevator or the like.

In accordance with the present invention, the alarming tag unit includes a first transmitter operating at a high frequency, and preferably ultra high frequency (UHF). The UHF transmitter is normally in an off condition although a signal may be transmitted on a periodic basis for supervision purposes. Any tampering with the band or strap of the tag unit, however, immediately creates the UHF signal which is transmitted throughout the restricted area and is received by any one of the UHF receivers and establishes the alarm alert condition. A second transmitter, however, continuously operates and generates a low frequency signal and preferably a very low frequency (VLF), which is confined to a well defined zone about the child. Use of VLF is desirable as it prevents the shielding of the signal with the body of some person who inadvertently or intentionally attempts to separate and interfere with the transmission of the monitor signal to the receiving units at any entrance/exit location.

Generally, the VLF signal will be below the AM broadcast band. In contrast, the high frequency signal will be an ultra high frequency (UHF) signal substantially above the AM broadcast band.

In addition, selected authorized personnel are provided with a deactivation unit which will deactivate the particular strategically located receiver units to permit removal of the monitor from the child and further permits necessary removal of the person from the secured area. Thus, in a hospital, nursing staff may be required to remove an infant or child for additional medical attention or procedure. The bypass feature also allows re-entry into the restricted area. The deactivation system also allows the removal of the alarming band unit. The strap itself is readily removed and disposed of, while the transmitter is preferably a sealed unit which can be readily cleaned for reuse.

More particularly in a preferred construction, the basic alarm system for infant and child security and, the like, will include three basic elements consisting of 1) a perimeter exit system; 2) a cut/removed band or strap detection system; and 3) a display/alarm/monitoring system. In systems particularly applied to infant and child monitoring, a small transmitting unit appropriate to their size is provided. In order to accommodate this relatively small size, at least two receivers for a single door, and four receivers for double doors, generally mounted orthogonally to each other, and the like are applied as a minimum to the perimeter of the door system and thereby improves the signal pickup as well as eliminating an orientation problem. The monitoring system may include interlocking control systems. For example, a door exit may have an interlock which will limit an alarm response to the actual attempt to open the door. This may be necessary in a secure system where the infant or child would necessarily move near an alarm door for certain reasons, for example, a door located along a busy hallway within the secured area.

Magnetic door locks are often used in areas to selectively lock a door under an alert condition, with the alarm set upon actual opening of the door. Because of fire safety codes and the like, the "maglock" unit must release after a very short period if continuous pressure is applied to the door. Actual opening will then affect the local alarm conditions.

The band alarm control system preferably uses a multiple and overlapping receiver cells system, similar to the concept of cellular radio systems. This ensures reception of the high frequency alarm signal. Thus, a controller for the system is located with the receivers in the ceiling, sides, and the like, and the alarm will lock local and remote sites, and are then generally reset only from the remote site to a local area. If desired, local reset can be provided.

In addition to the basic lock and control system, various options can be provided such as display at various combinations of local and remote alarm stations.

Further, the local alarms can be coded to distinguish between controllers and each controller can be separately or uniquely coupled to drive a remote panel, which displays the controller location to one or more alert panels. Individual identification labels can be applied and displayed at a desired alert panel structure, such as a common "Visinet" console, which may or may not have a printing system attached for purposes of maintaining a printed record of the outputs. Systems with such a cable terminal output can, of course, also provide input into a main console computer for various functions related to the security and record purposes. The display can also provide for display of the system through use of appropriate software which will not only lay out the system but separately identify the location of an alarm site, and if necessary or desired, appropriate recording thereof, in detail, as well as providing visual indication of the location by infant number, name and the like. The system can include voice alarm as well as wireless paging systems.

Various combinations of the system can be applied to the particular requirements of the facilities to maintain maximum degrees of specifications of security as desired and required.

In addition, various reset and bypass modes can be incorporated into the system for various short periods of time depending upon the particular authorized status, and in some instances, with no bypass. For example, any control location, such as a door control system, can be provided with an appropriate security keypad unit, a "wand" activated unit, key unit and other control devices to provide for bypass and reset of the alarm state at the particular controller. The unit can also incorporate an external reset or bypass feature, with either local or remote control via a multiple cable system.

In summary, the present invention provides an alarm monitoring system for providing safe and secure environments, particularly for newborns and children, parents and medical staff within a secured facility based on a cost effective combination of a dual transmitting tag unit attached to the person and a plurality of receivers appropriately located within the secured areas and responsive to tampering of the tag unit and unauthorized movement of the monitored persons.

The various aspects of the invention including the various options are more fully disclosed in connection with the preferred embodiment, as hereinafter disclosed and described in sufficient detail.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DESCRIPTION OF THE ILLUSTRATED EMBODIMENT

Figure 1:
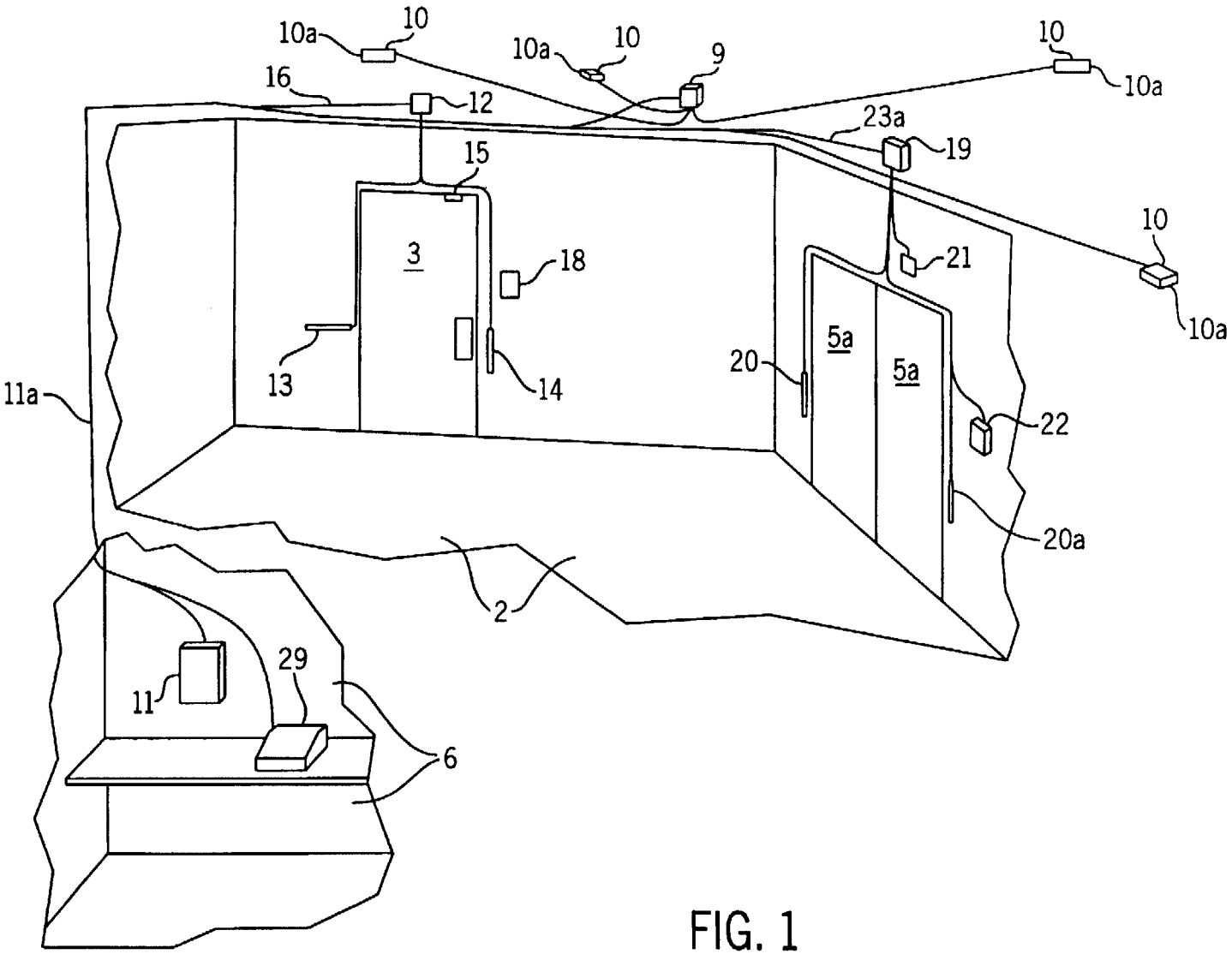
FIG. 1 is a diagrammatic illustration of a secure area incorporating a security system constructed in accordance with an embodiment of the present invention.

FIG. 1 is a diagrammatic illustration of a hospital or other area in which infants and children may be temporarily housed after birth or while receiving medical care and the like, and which is now generally desirably provided with security features to protect from abduction of the infant or child. In FIG. 1, a protected area 2 is diagrammatically illustrated having a door 3 for entering and exiting of the area. The area 2 may typically be a hospital ward or wing in which infants are placed for one or more days after initial birth. The door 3 may lead to non-secured areas. Other egress/ingress points might include an elevator 5 with doors 5*a*. The various rooms and other areas associated with infant care and housing generally include a suitable communication system to a central nurses station, a main security station or the like, such as diagrammatically shown at 6. Various call and monitoring communications systems have been used to permit communication between these several areas. The present invention is directed to limit movement and particularly exiting with respect to the several areas to protect the child from abduction, other unauthorized removal from the designated area or areas and the like.

Figure 2:
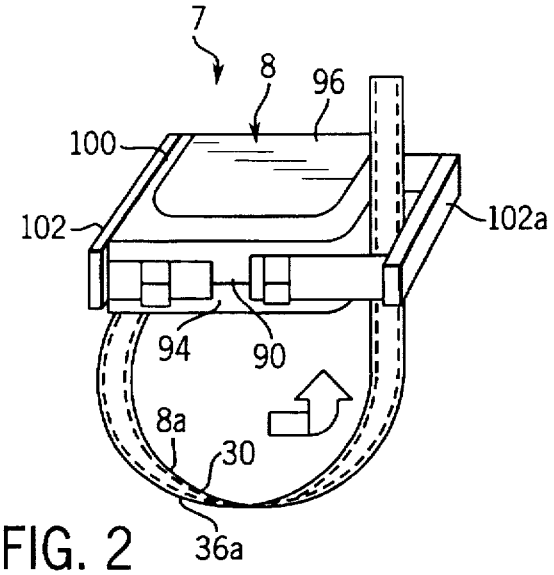
FIG. 2 is a pictorial view of a tag unit constructed for releasable attachment with the ankle or leg of a child.

In accordance with the illustrated embodiment of this invention, an identification tag 7, such as shown in FIG. 2, is attached to the child. The tag 7 (FIG. 2) includes a transmitter 8, which is operative to generate two distinct RF signals, as more fully developed hereinafter. The identification tag 7 is secured to the infant by a strap 8*a*, which is interconnected to the opposite sides of the transmitter 8, and is specially constructed to complete the circuitry of the transmitting circuitry within transmitter 8. Although the strap mounted transmitter unit 8 may include any desired structure, the structure preferably includes a mechanical interlock between the transmitter 8 and the strap 8*a*, with circuit connections to control the transmitting circuitry and sound an alarm with tampering or unauthorized removal of the strap 8*a*. Also, as more fully developed hereinafter, the tag 7 is conventionally attached to the wrist, or to the leg immediately above the ankle, of the infant and activated to generate the two distinctly different RF signals. In the present invention in a preferred construction, the transmitter 8 generates a low frequency RF signal, hereinafter referenced as a VLF signal, for monitoring the exit and entrance of an infant within the monitored secured areas 2, and an ultra high frequency signal thereinafter referenced as a UHF signal to monitor any removal or other tampering of the attachment of the transmitter 8 on an infant. The secured areas 2 are provided with appropriate receiving devices for responding to the respective signals, as follows.

Referring again to FIG. 1, a high frequency controller 9 is mounted, preferably in hidden relation within the secured areas, and includes circuitry responsive to a UHF signal generated by any identification tag 7 (FIG. 2) attached to the several children within the secured area. The single UHF controller 9 may cover a relatively substantial secured area. A plurality of high frequency antenna receivers 10, each with a suitable antenna 10*a*, may be distributed throughout the secured areas 2. In a practical application, applicant has used one system with one UHF controller centrally located and connected to four different receivers 10 which are strategically distributed and placed within each quadrant of a secured area of about 25×25 square feet and wired to the one controller. If the area is too large, a plurality of controllers 9 would be required to insure response to all transmitters.

If any tag 7 within the secured area is removed or tampered with in an attempt to avoid the security, the UHF signal is generated, picked up by one or more of the receivers 10, and transmitted to the UHF controller 9 and thereby creates an alarm state.

The controller 9 may have a local alarm unit, which will create a visual and/or audible alarm within the immediate secured area. In addition, it will generally be connected to the central or control station 6, which has an appropriate monitor 11, including an alarm unit. Generally, the various elements are cabled or hard wired, with hidden wiring, for example as shown by cable 11*a*. The wiring may be provided with appropriate security to prevent tampering therewith.

Each tag 7 (FIG. 2) may create a unique encoded VLF signal and the controller 12, 19 may decode that unique identification and transmit such identification to a local or remote station, such as station 6.

Each exit, such as door 3 or elevator 5, from a secured area 2 is provided with a separate controller specially constructed to respond to the VLF signal generated by an identification tag 7, which may again be an individual band encoded low frequency signal.

Referring particularly to the area 2 and door 3 of FIG. 1, a door controller 12 is diagrammatically illustrated, mounted above the door 3, and preferably in hidden orientation within the wall structure. Low frequency receivers 13 and 14 are located adjacent to the single door 3 to pick up VLF signals generated by any unit 7 as a monitored child approaches the door 3. The receivers 13 and 14 are thus located to maintain response in the event of one attempting to defeat the security because of orientation and shielding with respect to the movement of a tag 7 into the field of the receivers.

In the illustrated embodiment of the invention, the door controller 12 is responsive only to an actual attempt to open the door 3 in an unauthorized manner. A suitable switch unit 15 is coupled to the door 3 to respond and sense the actual opening or attempt to open the door. The switch unit 15 may typically be a reed switch having a door mounted member and a fixed wall mounted member as shown, an infrared responsive switch assembly similarly mounted, or any other suitable and desired sensing system, which will generate an appropriate signal to the controller 12 upon the initiation and/or actual opening of the door 3. Such a condition in the presence of a VLF signal from a tag 7 generates an alarm state with the corresponding local alarm condition and preferably a remote alarm signaling. Thus, under an alarm state, the output of controller 12 would transmit a signal via a cable 16 to the remote unit 11. In addition, the controller 12 may have a local alarm which is connected by a cable 17 to a control unit 18 shown mounted to one side of the door 3 and having an alarm unit built therein.

For other exits such as the elevator 5, a separate controller 19 is provided. Controller 19 is illustrated having an input cable to two sets of orthogonal low frequency receivers 20 and 20*a*, suitably mounted to opposite sides of the elevator doors. The security system for an elevator unit is also typical of a double door unit to a room or area. Thus, at a double door unit, each set of receivers 20 and 20*a* includes a vertical and a horizontal oriented receiver, as shown. A door interlock 21 may again be provided and interconnected to the controller 19 to respond to the attempt to use the elevator. In this instance, the response may allow the doors 5*a* to open but prevent closing and therefore operation of the elevator. An elevator door control unit 22 is shown adjacent the elevator and wired to controller 19 and through cable 23*a* to the remote alert unit 11. Control unit 22 includes a suitable alarm and interrelated control.

Figure 3:
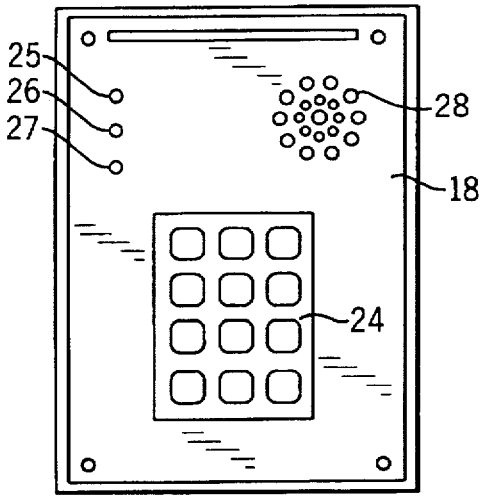
FIG. 3 is an elevational view of a control unit shown in FIG. 1 for monitoring an entrance/exit opening to the secured area.

A typical local door control unit 18, or 22, is diagrammatically illustrated in FIG. 3. Thus, the door control unit 18 includes a keypad panel 24 which may be used for entering of a particular code into the door unit 18 and thereby the controller 12 by authorized personnel to prevent creation of an alarm upon actual opening of the door with the corresponding coded tag unit in the area of the receivers. In addition, the door control unit 18 includes status lights, shown as an "on" status light 25, an "active" status light 26, and a "bypass" light 27, the latter indicating that a deactivation code has been entered and accepted. Turn-on of the deactivation light 27 permits the opening of the door 3, without producing an alarm for a selected short time period, generally preset between 5 and 60 seconds. The control unit 18 is diagrammatically illustrated with an audible alarm 28, which is activated in the event of an unauthorized location of a tag 7 (FIG. 2) adjacent the door 3. Unit 22 may be similarly constructed.

Figure 4:
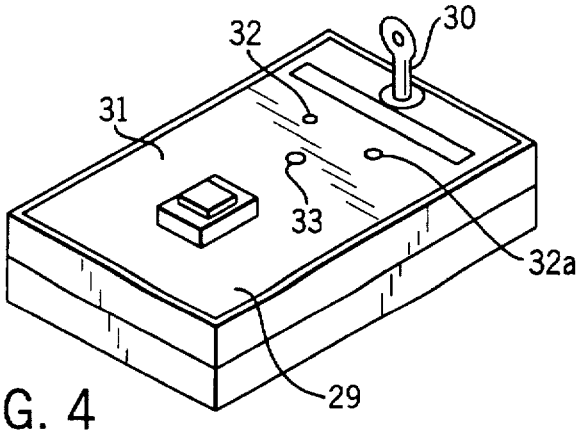
FIG. 4 is an elevational view of a deactivation unit for selectively deactivating portions of the controls in a secured area.

In addition, the controllers 9, 12, 19 are preferably programmed to receive a transmitted signal for deactivating of the controllers for an appropriate code. For example, a typical controller deactivating transmitter unit 29 is illustrated in FIG. 4. The decoding transmitter unit 29 is usually provided with a security lock, such as a key operated on/off control 30. A transmit button 31 is provided to permit generation of a coded "bypass" signal by authorized personnel. The unit 29 further includes appropriate status lights, such as power on light 32 and activation or time light 32*a* and beeper 33 indicating appropriate deactivation of the control for a given period. The deactivation code will only permit removal or changes in the tag unit attachment or operating of the door, elevator or other secured exit, for a limited period of time, such that generally one tag 7 (FIG. 2) can be attached or removed and only the one individual or infant can be moved by authorized personnel.

The present invention thus provides a dual mode operational security system, including a personnel attached transmitter or tag unit transmitting a first unique signal to ensure the attachment of the tag 7 and a second unique signal to selectively monitor the movement and particularly the controlled exit and entrance of monitored personnel within the secured area.

Figure 5:
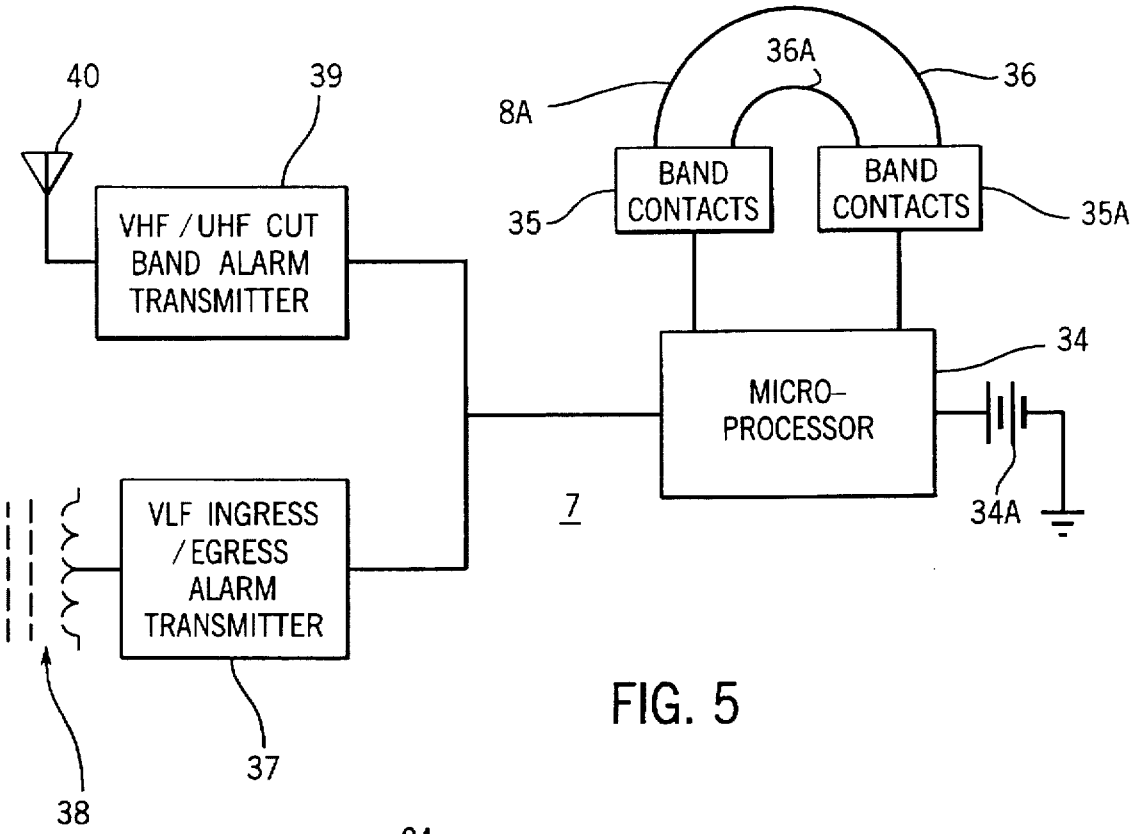
FIG. 5 is a block diagram of the tag unit shown in FIG. 2.

More particularly, the dual mode operational transmitter 8 of FIG. 2 is diagrammatically illustrated in block diagram in FIG. 5. The tag 7 includes a housing with a microprocessor 34 interconnected with an internal battery drive 34*a* therein. The band or strap 8*a* and housing includes band contact units 35 and 35*a*. The contact units 35 and 35*a* are coupled to the microprocessor 34 and to a single or pair of wires 36 (and 36*a*) embedded with the attachment band or strap 8*a*. The wire or wires 36 (and 36*a*)activate and control the energization of the microprocessor 34. The microprocessor 34 in turn drives a VLF alarm transmitter 37 having an appropriate antenna 38 and a VHF or UHF alarm transmitter 39 (hereinafter referred to as a UHF transmitter for simplicity of explanation) having an appropriate antenna 40. Cutting or removal of the strap 8*a* will sever the circuit connection and disable the low frequency transmitter 37. However, such cutting or removal activates the UHF transmitter 39, absent some prior deactivation action, creating an alarm condition generally as previously discussed.

Figure 6:
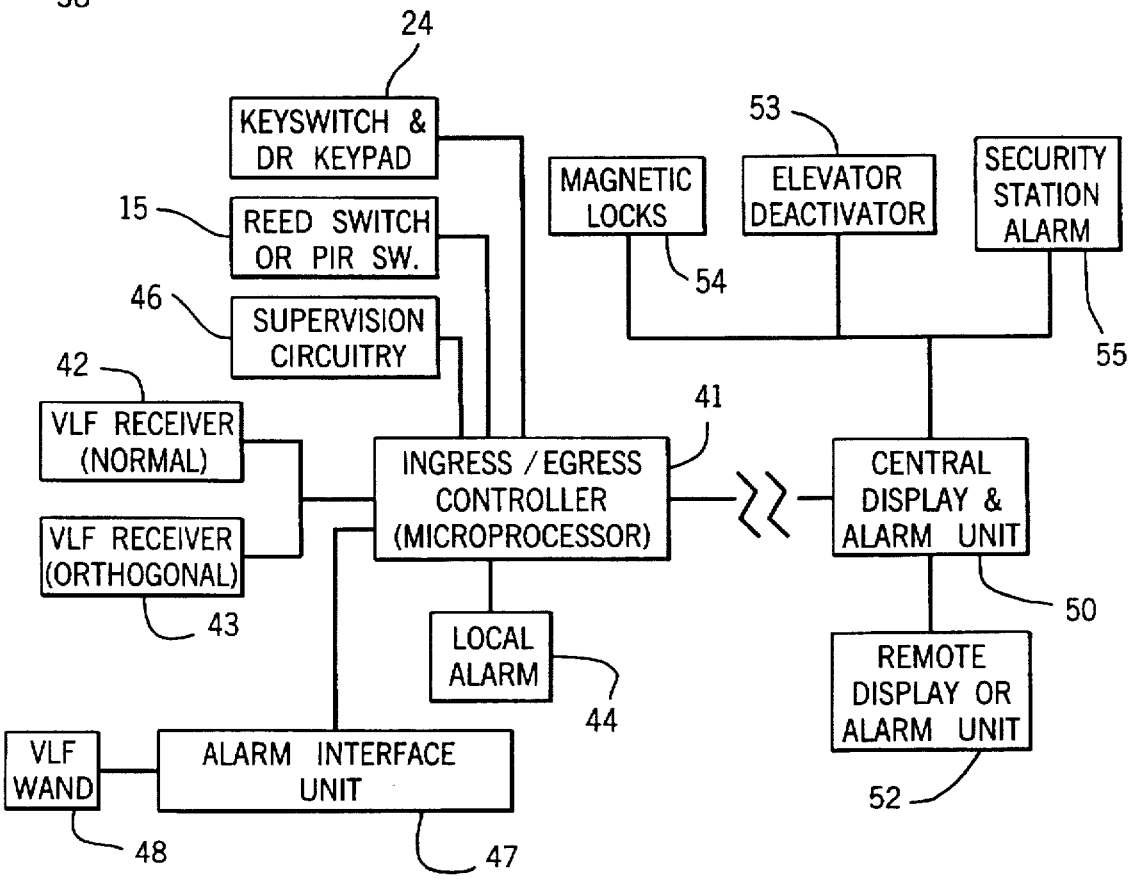
FIG. 6 is a block diagram of the control system applied to a door opening in FIG. 1.

FIG. 6 is a block diagram of a typical exit alarm controller 12 or 19 and associated elements or components. Thus, the controller 12 or 19 includes a suitable microprocessor 41 having an input connected to a conventional or normal VLF receiver 42, as well as the orthogonal VLF receiver 43. In response to an appropriately received coded signal, the microprocessor 41 is conditioned to create an alarm condition for a local alarm unit 44. As shown, the reed switch, or an infrared monitoring door switch 15 is connected to an input of the microprocessor 41 (FIG. 6) and interlocks the output in association with the receiver signals to opening of, or attempting to open, the door. In addition, the processor is preferably provided with a supervision circuitry 46, which monitors the input signal from the antenna/receiver units.

If the antenna/receiver unit is broken or otherwise tampered with, the supervision circuit 46 will detect the malfunction or tampering with the receiver/antenna unit and provide an alarm state. In a preferred construction, the low frequency controller responds to a low frequency fault condition in the event activity is not detected within approximately one-half second to take a first action and to establish an alarm state after approximately one second, and said high frequency controller provides a corresponding response to any high frequency fault condition to take first action after approximately two seconds and to establish an alarm state after approximately five seconds.

The keypad 24 of control unit 18, or a key switch unit or the like, is also shown interconnected to an input of the controller processor 41 to provide for bypassing and/or reset of the activated processor 41. If an alarm condition is established, the system must be reset after appropriate action responsive to the alarm condition. The keypad 24 thus includes a reset code and a disable code. The disable code, with the momentary interactive inaction, inactivates the processor to the received signal for a predetermined period, which is preferably adjustable by a suitable input control within the processor 41. The total system may also incorporate a separate alarm interface unit 47 interconnected to the processor 41 to function as a timed bypass input. Thus, such an alarm interface unit 47 might be used where a keypad for a control unit is not exposed. A simple box-like member is interconnected to the control unit 18, for example, to activate the bypass circuitry in same manner as when a keypad is provided. A special low frequency wand input 48 and the control personnel has a wand, not shown, can activate the alarm interface unit 47 to activate the bypass circuitry of the processor 41 for a selected short period.

In addition to the local system, as shown in FIG. 6, the output may be connected to the alert unit and particularly a central display and alarm circuitry control such as shown in 50. The circuitry may be mounted within the control unit 18 or as a separate unit inter-connected to the controller outputs. The display and alarm unit 50 is shown interconnected to drive various security systems as well as a further remote display or alarm unit 52, such as the central alert unit 11, or other remote units provided at a main security office or gate and the like.

In addition, the unit 50 provides output to activate other systems such as the elevator deactivator 53, which will positively prevent operation of the elevator, as by prevention of the closure of doors 5*a*. In addition, a door 3 may have a magnetic locking system such that an alarm condition activates the alarm and the display to identify the location, but simultaneously activates a magnetic lock unit 54 on the related door 3 to positively prevent opening of the associated door but permit opening in response to a given pressure for a selected period for safety reasons. Finally, in the illustrated embodiment of FIG. 6, the output of the central display and alarm unit includes the connection to a remote security station 55. The security station on signaling of an alarm condition can take appropriate action to prevent removal from not only the secured area but also from within a larger area, such as the building structure itself.

Figure 7:
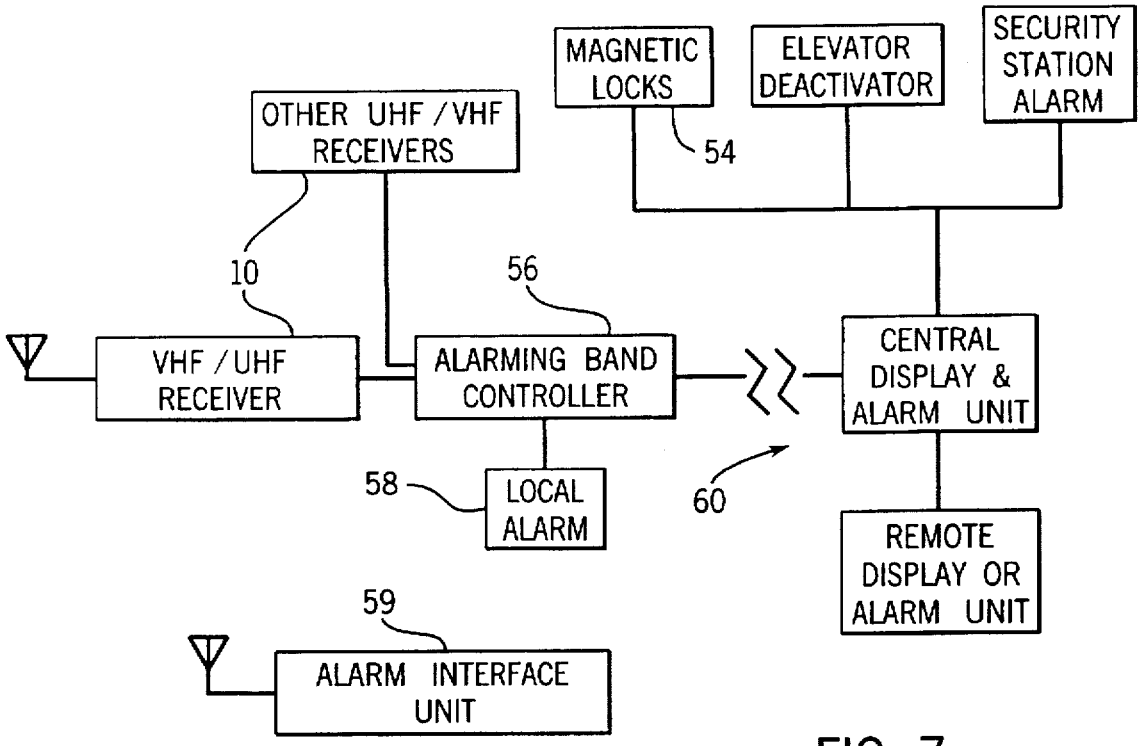
FIG. 7 is a block diagram of a secured area response system to detect tampering with an activated tag unit.

FIG. 7 is a similar view of a UHF controller 9 and is basically similar to that of the entrance/exit VLF alarm system of FIG. 6. The UHF controller 9 includes a microprocessor 56 having a plurality of inputs individually connected to the distributed UHF receivers 10 (FIG. 1) and is operable to trigger a local alarm 58 under alarm conditions, such as a broken strap 8*a*, disconnection of the strap 8*a* from the microprocessor housing 8 and thereby the microprocessor circuitry or the like.

In FIG. 7, an alarm interface unit 59 is illustrated, such as shown in FIG. 4. The alarm interface unit 59 transmits a UHF signal to an appropriate adjacent receiver or receiver 10. The signal transmitted is connected to a bypass circuitry within the microprocessor 56, which decodes the received UHF signal and momentarily deactivates the alarm signal processing. Absent such deactivation of the system, the output of the alarming strap processor 56 is coupled to output circuitry 60 illustrated as corresponding to that of the output circuitry of the entrance/exit alarm circuitry of FIG. 6.

Figure 8:
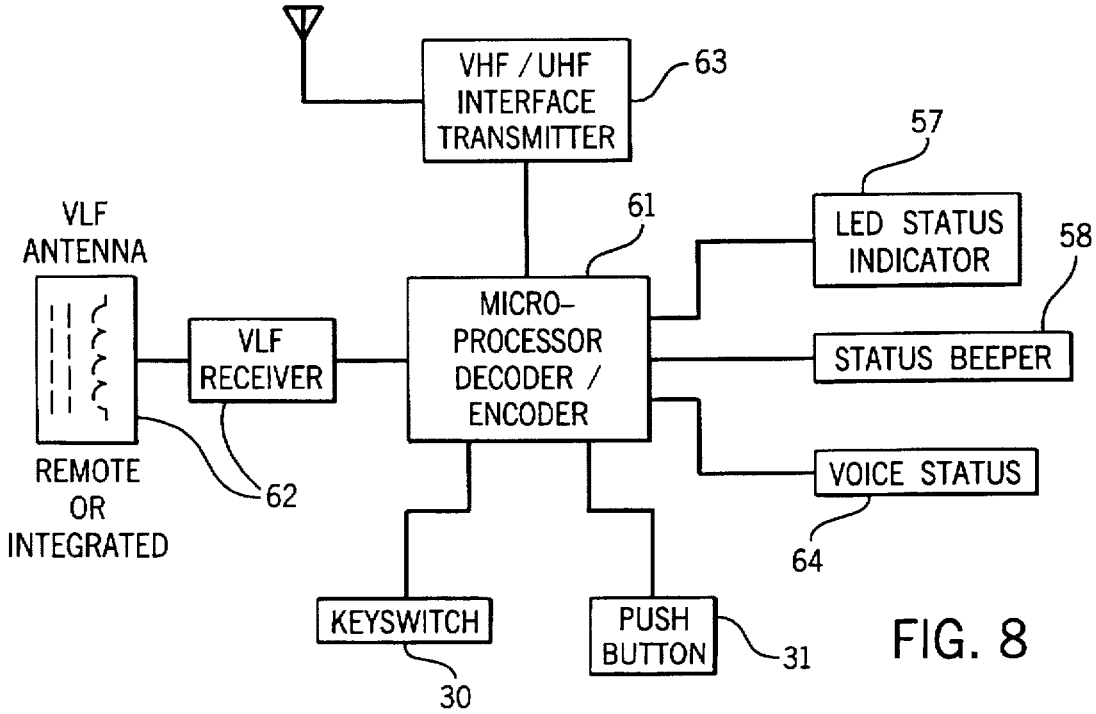
FIG. 8 is a block diagram of a deactivation unit such as shown in FIG. 4.

FIG. 8 is a block diagram of an alarm interface unit 59, with a system as shown in FIG. 4, for deactivating the band alarm system during installation and removal of a tag 7. The unit 59 consists of a microprocessor 61 having a decoding and encoding circuitry. Referring to FIGS. 4 and 8, key switch 30 is connected to the microprocessor 61. Push button 31 is operable to activate the microprocessor 61 during the attachment and removal of a tag 7. The unit has the LED power status indicator 32, 32*a*, shown at 57, and beeper 33, shown at 58, in the illustrated embodiment of FIG. 8. Thus, the microprocessor 61 drives the LED status indicators by illuminating the LED indicators, for example as shown in FIG. 4, to indicate that the initial turn of the switch key. Operation of the push button 31 initiates the bypass cycle and drives the LED status indicator 32*a* as shown in FIG. 4. A status beeper 33 of FIG. 4, shown at 58 in FIG. 8, may be provided to audibly indicate the time duration and when an ending is rapidly approaching. A voice announcement 64 may also be included in the alarm interface unit (FIGS. 4 and 8).

Thus, immediately upon activation of the push button 31, a timing cycle is initiated during which the microprocessor 61 receives the signal via a VLF antenna and receiver 62 to respond to the output of the tag 7 and to decode the same. Upon reading and decoding of the tag unit signal, microprocessor 61 activates a UHF interface transmitter 63 and transmits the UHF signal to a receiver 10 and thereby the related controller 9. The transmitted deactivation signal is processed by the controller 9 to disarm the alarming system and permit attachment of the unit 7 or removal thereof by cutting of the strap or the like. Again, the deactivation period may be timed under control of the microprocessor 61.

Figure 9:
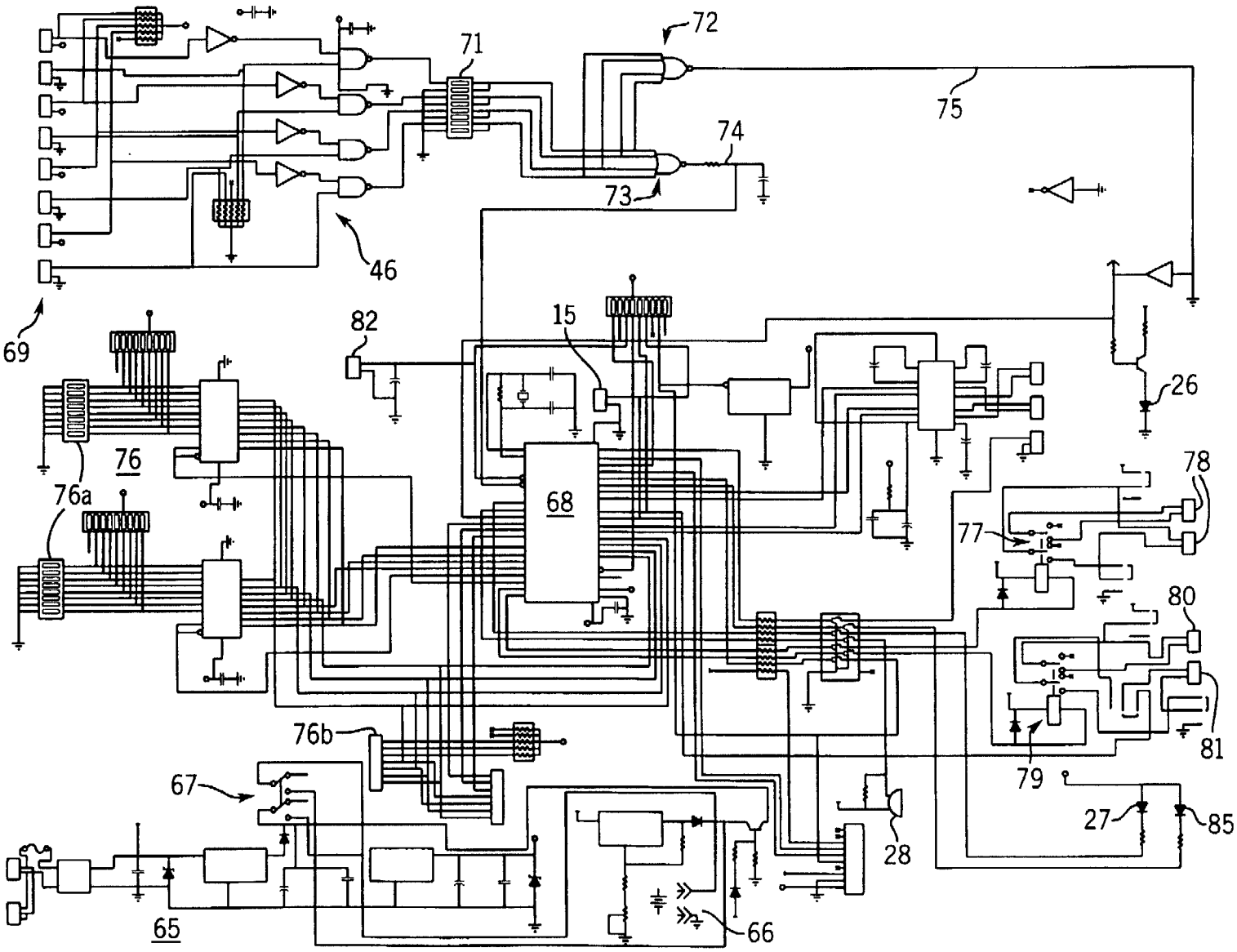
FIG. 9 is a circuit diagram of a controller as shown in the security system of FIG. 1.
Figure 10:
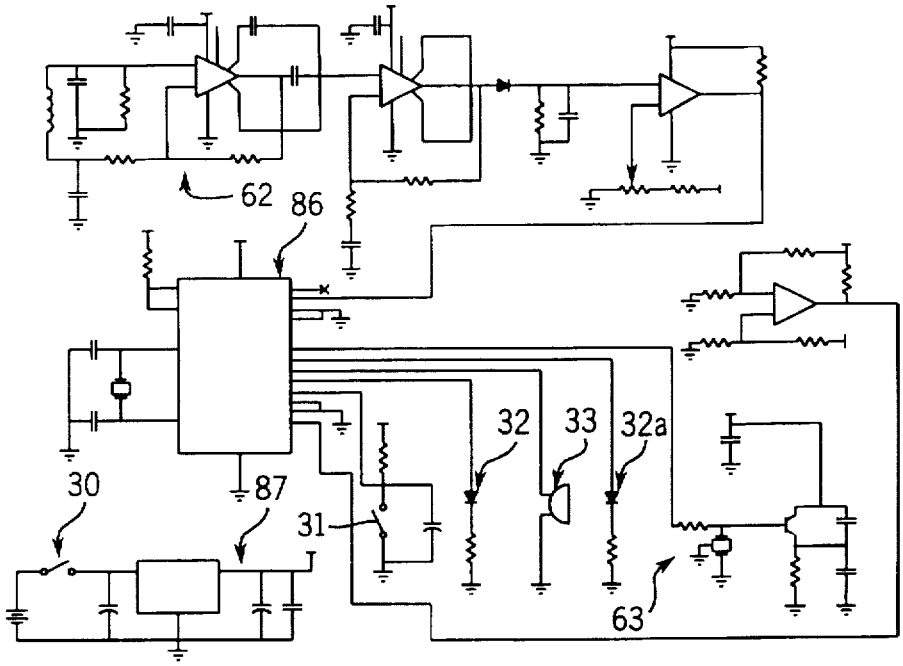
FIG. 10 is a schematic circuit of a deactivating interface unit shown in FIG. 4 and FIG. 8.

Although the components of the several interface units, controllers and tag units may be of any suitable construction, practical operative circuits are shown in FIGS. 9 and 10.

A schematic circuit diagram for use with the controllers 9, 12 and 19 is illustrated in FIG. 9. The illustrated circuit of FIG. 9 is particularly described with reference to VLF receivers, for purposes of description. A power supply 65 for connection to a conventional 120 volt distribution circuit in the building provides power to the controller. A battery 66 is also provided with a switch 67 for selectively connecting one of the two supplies to maintain power to the controller circuits. The power is supplied to a processor 68 (such as an MC688C711D3), which engages the power light 25, also shown in FIG. 3. A bank of receiver inputs 69 is adapted to be connected to a plurality of VLF receivers 14 and 20. A logic supervision circuitry 46 interconnects the output of the individual receiver inputs to a Dip switch 71. First and second logic units 72 and 73 are similarly connected to switch 71 and establish first and second signal lines 74 and 75. Line 74 is connected to the processor 68 and line 75 is connected to a second input of the processor and to the circuit of the active light 26, also shown in FIG. 3, thereby indicating receipt of an VLF signal. The VLF signal is decoded by the processor 68 to determine whether an alarm code or bypass code was received.

The bypass code signal automatically activates a timer in the microprocessor 68 and deactivates the alarm response of the system for a predetermined time period as set by switches 76. An internal/external keypad **76*b* may also be used to deactivate the controller. Generally, the time may practically be set to expire within a range of 5 to 60 seconds. In a practical application, periods of 5, 15, 30, 45 and 60 seconds may be selected depending upon the particular door and the activity anticipated. In this status, the bypass light 27, also shown in FIG. 3**, is driven on for a corresponding period.

If an alarm condition exists, processor 68 responds by activating various outputs. As related to the previous description, the alarm buzzer 28 is driven on. A first relay unit 77 is set and supplies power to remote display output 78, such as the remote station 6, a second relay unit 79 is activated to set a door lock 80, if so wired, and a third for preventing operation of the elevator 81. A bypass/reset input unit 82 is adapted to be connected to bypass unit 24, a simple pushbutton unit, an alarm interface unit 47 or the like to activate the bypass or reset program of the alarm system, for example as shown in FIG. 6.

The illustrated circuitry will be readily understood by those skilled in the art, and no further description of the details shown is deemed necessary or desirable.

The UHF controller 9 preferably includes the same or similar circuit system.

A schematic circuit is shown in FIG. 10 for the interface unit, shown in FIGS. 4 and 8 for deactivating of the UHF controller 9 while attaching or removing a tag 7 (FIG. 2). The unit includes the antenna and VLF receiver 62 of FIG. 8 for receiving the encoded alarm signal from the transmitter 37 of tag 7, as shown in FIG. 5. A processor 86, (shown as a P1C16C54) processes the signal as a bypass code. The processor 86 activates the UHF transmitter circuit 63, the output of which is transmitted by an antenna to the UHF receiver 10 of the controller 9. Controller 9 decodes the incoming signal to automatically bypass the output for a preset period of time. The processor 86 includes outputs to the red and green status indicators of FIG. 4, such as LED lamps 32, **32*a* and beeper 33 to indicate the turn on power and activation of button 31 as well as the time period for removing of or modifying of the tag unit connection. The portable unit 29 has a separate battery driven power supply 87** which provides output power to a circuit for establishing appropriate voltage to the circuitry as illustrated.

The illustrated system thus provides an improved dual mode response unit which can be used with any tag unit having a dual transmitting characteristic.

Figure 10A:
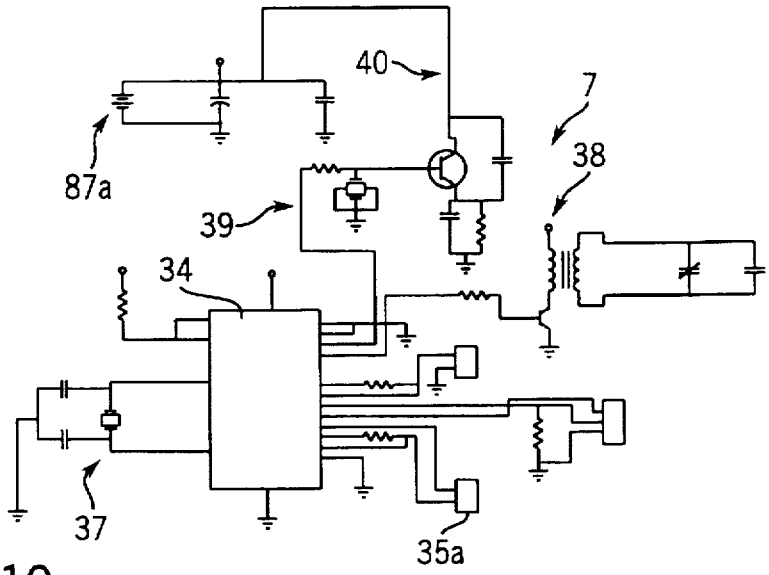
FIG. 10*a* is a schematic circuit for the tag unit 7 as shown in FIGS. 2 and 5.

A typical circuit for tag 7 is shown in FIG. **10*a*, wherein the circuit components are numbered in correspondence to the block diagram of FIG. 5. In FIG. 10*a*, the battery source 87*a*** is also shown.

A typical example for operating of the illustrated system is as follows.

As previously defined, the identification tag 7 is a radio frequency transmitter operating at two different frequencies. Each frequency signal established has the same ID pattern unique to the particular tag 7. The movement ID pattern for a particular tag unit is transmitted at a VLF frequency of one second intervals. All door controls "continuously listen" for a transmitted ID pattern. The UHF transmitter is normally quiet, but when activated, transmit a similar ID pattern at a UHF frequency. The stop controllers 18 and 20 listen for a corresponding UHF signal from any one of the ID signals. The UHF signal is only generated, however, if a strap **8*a* is opened or otherwise disconnected from the transmitter unit 8**, without prior deactivation of the controllers.

Figure 11:
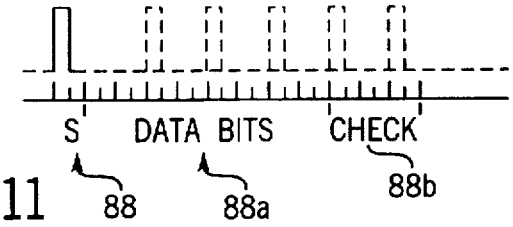
FIG. 11 is a graphical illustration of the security signals transmitted by the tag unit.

In one practical operation, the tag data pattern was established as a binary sequence essentially consisting of a start bit 88, eight data bits **88*a* representing the tag 7 and three checksum bits 88*b*, as shown in FIG. 11. The ID pattern consisted of an initial one start bit, eight data or ID bits and a final three check-sum bits. The data pattern byte represent the tag ID and establishes a range of 1 to 254 permitted ID tags. This data is transmitted with the most-significant-bit (msb) first. Generally, as applied to a child or infant security system, the tag range was restricted to either 1 to 63 tags or 1–127. The checksum bits 88*b*** is selected as a binary representation of the number of zero bits in the data bit and such pattern is transmitted with the least-significant-bit (lsb) first. The system was established such that the checksum bit of three bits would always be non-zero.

In a practical application, the timing and the pattern of transmission was the same for both VLF transmission and the UHF transmission. The particular timing chip resulted in some slight variation in the one second transmitting interval. The pulse spacing, however, within the tag data pattern, was always fixed. An ideal pattern selected included 490 microsecond wide pulses appearing at a time pattern beginning with time equal to 0.0, as follows:

| | | | | | |
|---|---|---|---|---|---|
| 0.0 | 0.973 msec | 1.946 msec | 2.918 msec | 3.891 msec | 4.864 msec |
| 5.837 msec | 6.810 msec | 7.782 msec | 8.755 msec | 9.728 msec | 10.701 msec |

The system may be provided with a day/night mode. Thus, during the night mode, it would be desirable to have all alarm status only reported to the nurse's station who would have the sole responsibility and authority to reset a door control. This system would minimize disturbing of other patients and personnel.

A preferred construction of the tag 7 is illustrated in FIGS. 2 and 12–14. Generally, the tag 7 includes an outer housing 94, 96 (FIGS. 2 and 12–14) within which a circuit board 91 (FIG. 12), with the battery power supply and associated circuitry mounted thereon, is securely mounted. Such circuit board 91 may be of any known or desired circuit board construction. The circuit board is mounted within the housing 94, 96 with a first set of contacts 92 aligned with and projecting through openings **92*a* on one side of the housing 94, 96, and a second set of contacts 93 projecting through openings 92*b* from the opposite side of the housing, as most clearly shown in FIGS. 13 and 14. The contacts of each set 92 and 93 are identically spaced laterally along the opposite sides of the housing 90. In the illustrated embodiment of the invention, each contact of the sets 92–93 is similarly constructed, as a flat, pointed contact with the sharp point(s) extending from the side of the housing 90 for interconnection to the strap 8***a*, and particularly for connection to the embedded wires 36 and 36*a* to complete the circuitry within the transmitting circuit of the tag unit as shown in FIG. 5. The openings about the projecting contacts are sealed in place by any suitable manner, such as by an epoxy adhesive.

Figure 12:
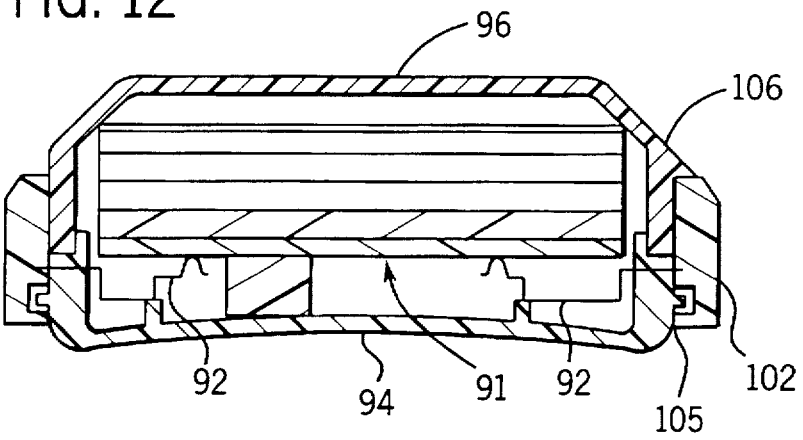
FIG. 12 is an enlarged diagrammatic cross-sectional view of the tag unit shown in FIG. 2.
Figure 12A:
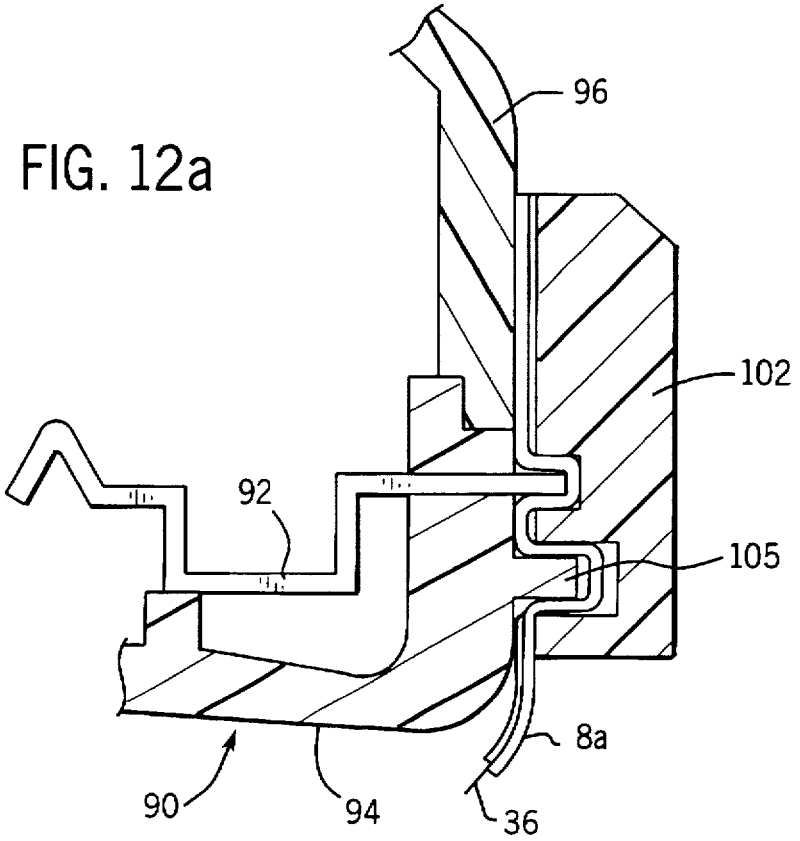
FIG. 12*a* is a fragmentary enlarged view of a portion of the tag unit shown in FIG. 2 and illustrating the circuit interconnection of the tag securement strap to the transmitting unit.
Figure 13:
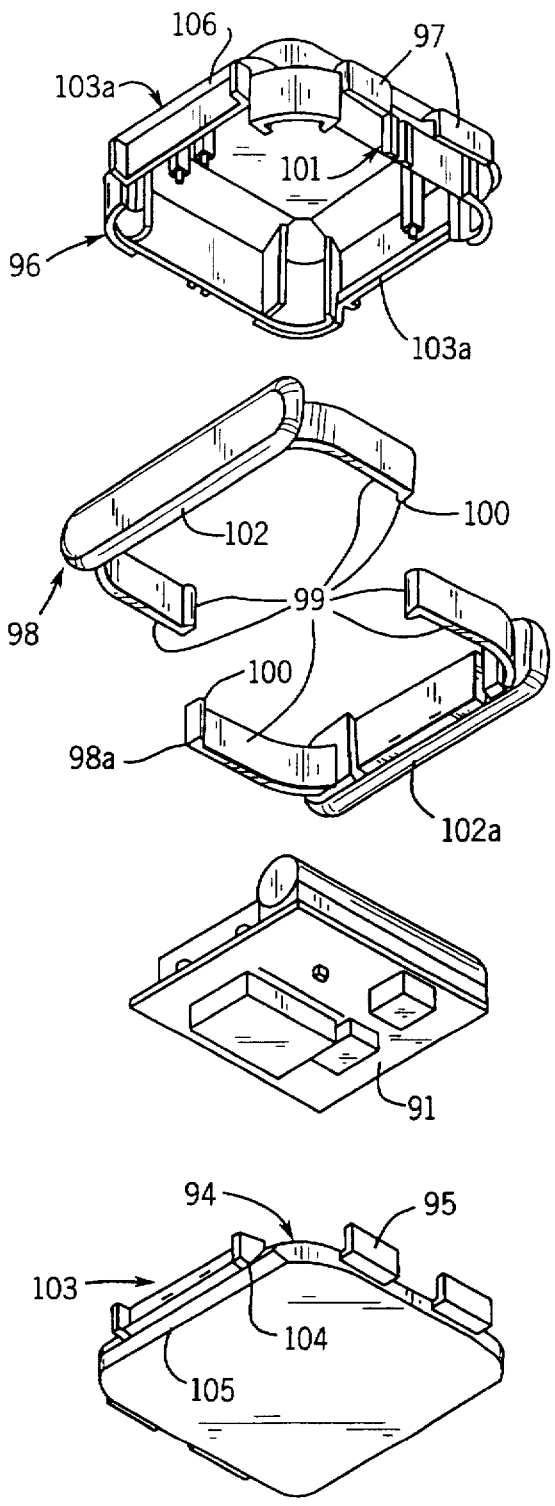
FIG. 13 is an exploded pictorial view of the components of the tag unit.
Figure 14:
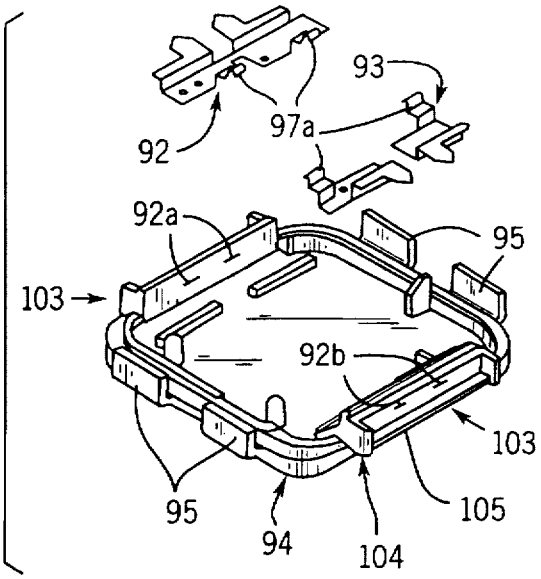
FIG. 14 is a separate view of an element shown in FIGS. 2, 12 and 13.

Referring to FIGS. 12, 12*a* and 13, the housing 94, 96 includes a two-piece molded assembly having a relatively shallow base 94 to which the contacts 92 and 93 are assembled and project from opposite contact side-walls containing openings 92*a* and 92*b*. Spaced L-shaped members 95 are formed on opposite walls and project upwardly of the bottom wall.

A deep housing cover 96, to which the circuit board 91 is staked, has similar L-shaped members 97, which with members 95, form side loops. The circuit board 91 has power contacts which engage the inner ends 97*a* of contacts 92 and 93 in the assembled relation of the housing base 94 and cover 96. The housing base 94 and cover 96 are adhesively joined to form a single integral member.

U-shaped band clamps 98 and 98*a*, of a similar construction, have side legs 99 slidably mounted with the side loops. The inner ends of the side legs 99 have inward lips 100 adapted to interengage serrated vertical notched portions 101 provided on the sidewalls of the housing cover 96. The U-shaped clips 98 and 98*a* each have a base 102 and 102*a* in opposed relation to the contact sides of the housing 90. In the extended open position, the clips define vertical openings between the housing 90 and the clip bases. The ends of strap 8*a* may be passed through the openings and thereby placed between the clip bases and the housing sidewalls and contacts 92–93. Pushing clips 98 and 98*a* inwardly locks the strap 8*a* to the housing.

The contact sidewalls of the housing base 94 and cover 96 are constructed with generally U-shaped, rectangular wall structures 103 and 103*a*, which are aligned and abutted in the assembled housing. Wall structure 103 and 103*a* are similarly constructed and each includes sidewalls 104 outwardly projecting from the housing sidewalls and a small bottom wall 105 projecting outwardly somewhat less than the distance of the side-walls 104. The contacts 92 and 93 project through openings 92*a* and 92*b* in the sidewall and are adhesively bonded within the base member 94. The spacing of the sidewalls 104 is essentially in accordance to the width of strap 8*a* to align the strap wires 36 and 36*a* with the exposed contacts 92 and 93. The cover member 96 has the matching wall structures 103*a* of a generally U-shaped to define the strap receiving openings.

The strap 8*a* is a flat strap member which is adapted to abut the sidewall of the housing, with the wires 36 and 36*a* aligned with the contacts. Closing of the U-shaped clips 98 and 98*a* force the straps 8*a* into the U-shaped wall structure 103 and 103*a*, with the contacts piercing the strap 8*a* and in so doing creates a firm electrical engagement between the contacts and the strap wires, thereby completing circuitry to the transmitting circuit. The inset bottom wall 105 deforms the straps 8*a* slightly and firmly locks the strap in place and with the contacts 92 and 93 firmly engaging strap wires 36 and 36*a*, as most clearly shown in FIG. 12*a*.

The one side of the cover member 96 includes a top wall 106 extended outwardly over strap receiving opening and defines a stop wall for locating the one end of strap 8*a* in place. The opposite side is open and allows the strap 8*a* to be secured about a limb and then severed along the top of the opening to secure the tag unit in place, as shown in phantom in FIG. 2.

The present invention provides an improved secure monitor system for securing of an area in a medical facility, with the VLF frequency movement monitor and the VHF/UHF system monitor in combination with the dual frequency mobile tag unit. The disclosed tag unit also provides an improved securement to the monitored individual. In the claims, the VHF/UHF signal and related component or circuit is generically identified as a very high frequency, except where specifically limited to the preferred ultra high frequency signal.

Various modes of carrying out the invention are contemplated as being within the scope of the following claims particularly pointing out and distinctly claiming the subject matter which is regarded as the invention.

We claim:

1. A personal monitor for attachment to the limb of a person and having a size appropriately related thereto, comprising a molded outer small housing for abutting attachment to the person, a transmitting unit within said housing including a programmable memory establishing a transmission circuitry and an antenna adapted to transmit radio frequency signals, said transmitting unit having circuit contacts exposed on diametrically opposite side walls of said housing, an elongated strap member having opposite free ends, said housing having a first and second tubular opening including said opposite side walls for receiving of said free ends of said strap member, said tubular openings including clip members movable between a release position for insertion of said free ends and an engaged position securing said strap in abutting engagement with said housing side walls and said contacts, said strap member having at least one conductor embedded therein and spaced in accordance with said contacts and interconnecting with said contacts and thereby completing said transmission circuitry, a locking unit within said tubular openings and said clip members to secure said free ends of said strap member in engagement with said contacts, and said transmitting unit including a unique transmitter operable in response to release of said locking means to transmit a unique alarm signal.

2. The personal monitor of claim 1 wherein said locking unit includes a structure for urging said strap member from said contacts and operable upon release positioning of said clip member to effectively force the free end from said engaged contacts and thereby activating said transmission circuitry.

3. The personal monitor of claim 1 wherein said housing includes an exterior exposed wall and wherein said first tubular opening includes an overlying stop wall extending laterally from the housing side wall whereby said strap member is inserted within said opening in abutting engagement with said stop wall, said second tubular opening being exposed from the exterior exposed wall of said housing whereby said strap member is adapted to be extended around the limb and through said second opening for firm attachment to the limb and then locked in place, said strap member being severable along said second tubular opening.

4. The personal monitor of claim 1 wherein said transmitting unit is operable to transmit a first signal having a low frequency and alternatively a second signal having a very high frequency, said transmitting unit being activated to generate said second signal upon movement of said clip member to a release position.

5. The personal monitor of claim 4 wherein said transmitting unit initiates transmission of said first signal upon completion of the transmission circuitry by said mounting strap member and continues such a transmission with said strap in place.

6. A monitoring security system for monitoring movement of a person with respect to a secured area, comprising a tag unit including a housing and a mounting strap unit for attaching of the housing to a limb of the person, a transmitter unit within said housing and including a first frequency transmitter transmitting a first signal having very low frequency and a second frequency transmitter transmitting a second signal having a very high frequency, said strap unit and housing having interlocking circuitry connections between the housing and the strap unit and operable to activate said first transmitter to transmit a first signal having a selected very low frequency signal encoded to a particular transmitter unit and interconnected to the second transmitter to activate the second transmitter in response to removal of the strap unit with respect to said housing, at least one first receiver responsive to said first signal and located adjacent selected exit/entrance opening to the restricted area, a plurality of second receivers responsive to said second signal and adapted to be distributed throughout the area to be secured, a low frequency controller coupled to said first receiver for establishing alarm conditions in the presence of the first transmitter in any tag unit within the secured area, a high frequency controller connected to said second receivers and each being responsive to receiving of said second signal within a select area adjacent said second receivers to establish an alarm condition, each of said low frequency and high frequency controllers including an alarm response circuitry, and each including a processor encoded to said first signal and to said second signal respectively and assigned within a secured area and operable to activate said alarm response circuitry, each of said low frequency and high frequency controllers including a by-pass unit operable to de-activate the alarm response circuitry of the respective controller for a predetermined by-pass interval and thereby to allow controlled removal of said housing and the exit and entry with respect to the secured area, and a deactivation unit for selectively deactivating said by-pass unit of said low frequency and high frequency controllers.

7. The system of claim 6 wherein said deactivation unit generates tag encoded signals for said tag units, said low frequency controller including means for identifying the coded signal and operable in response thereto to deactivate said low frequency controller for the encoded tag unit, and to simultaneously transmit said encoded tag signal to said high frequency receiver to deactivate said high frequency controller for said tag unit.

8. The system of claim 6 wherein said secured area includes at least one exit/entrance opening including a door assembly, a door monitor operable in response to the position of said door assembly between an open and closed state, said first controller being inter-connected to said door monitor to limit an alarm state to a selected position of the door assembly.

9. The system of claim 8 wherein said door monitor responds to an initial opening of the door assembly.

10. The system of claim 8 wherein said door assembly is part of an elevator assembly, said door monitor being interconnected to said low frequency controller to prevent closing of said elevator door assembly in response to an alarm state.

11. The system of claim 8 including a positive door lock secured to each selected door assembly, said door lock being activated in response to establishing of an alarm state and maintaining said selected door assembly locked for a selected period.

12. The system of claim 6 wherein each of said door assemblies includes at least two exit/opening receivers orthogonally oriented to maintain response independent of the orientation of the first transmitter unit within the range of the exit/opening receiver.

13. The system of claim 6 wherein each of said low frequency and high frequency controllers includes an antenna connected to the receiver connected thereto and an antenna supervisory circuitry and establishing an alarm state in response to any antenna fault condition of said antenna and receiver connected to said controller.

14. The system of claim 13 wherein said low frequency controller responds to a fault condition in the event activity is not detected within an approximately one-half second to take first action and to establish an alarm state after approximately one second, and said high frequency controller provides a corresponding response to any high frequency malfunction or fault condition to take first action after approximately two seconds and to establish an alarm state after approximately five seconds.

* * * * *